US007160364B2

(12) United States Patent
Mischkulnig

(10) Patent No.: US 7,160,364 B2
(45) Date of Patent: Jan. 9, 2007

(54) DISCHARGE ELECTRODE

(75) Inventor: August F. Mischkulnig, Johannesburg (ZA)

(73) Assignee: Geecom (PTY) Limited, Honeydew (ZA)

( * ) Notice: Subject to any disclaimer, the term of this patent is extended or adjusted under 35 U.S.C. 154(b) by 0 days.

(21) Appl. No.: 10/831,337

(22) Filed: Apr. 23, 2004

(65) Prior Publication Data

US 2004/0237788 A1 Dec. 2, 2004

Related U.S. Application Data

(63) Continuation of application No. PCT/IB01/01975, filed on Oct. 23, 2001.

(51) Int. Cl.
*B03C 3/41* (2006.01)

(52) U.S. Cl. ..... 96/83; 96/84; 96/87

(58) Field of Classification Search ..... 96/83, 96/84, 92, 95, 97; 55/DIG. 38
See application file for complete search history.

(56) References Cited

U.S. PATENT DOCUMENTS

| | | | | | |
|---|---|---|---|---|---|
| 1,333,790 | A | * | 3/1920 | Bradley | 95/79 |
| 2,505,907 | A | * | 5/1950 | Meston | 96/97 |
| 3,257,779 | A | * | 6/1966 | Strubler | 96/54 |
| 3,765,154 | A | * | 10/1973 | Hardt et al. | 96/88 |
| 4,277,258 | A | * | 7/1981 | Bojsen | 96/97 |
| 4,303,418 | A | | 12/1981 | Coe, Jr. | |
| 4,375,364 | A | * | 3/1983 | Van Hoesen et al. | 96/87 |
| 4,848,986 | A | | 7/1989 | Leluschko et al. | |
| 4,948,399 | A | * | 8/1990 | Reuffurth et al. | 96/92 |
| 5,100,440 | A | * | 3/1992 | Stahel et al. | 96/97 |
| 5,254,155 | A | * | 10/1993 | Mensi | 96/44 |
| 2004/0255784 | A1 | * | 12/2004 | Johansson | 96/95 |

FOREIGN PATENT DOCUMENTS

| | | | | | |
|---|---|---|---|---|---|
| AU | 401997 | A | * | 3/1970 | 96/97 |
| CN | 2380302 | Y | | 5/2000 | |
| DE | 1 201 816 | B1 | | 9/1965 | |
| DE | 3539200 | A | * | 5/1986 | 96/97 |
| JP | 56-37061 | | * | 4/1981 | 96/97 |

* cited by examiner

*Primary Examiner*—Richard L. Chiesa
(74) *Attorney, Agent, or Firm*—Darby & Darby

(57) ABSTRACT

A discharge electrode for an electrostatic precipitator has a collar having two oppositely disposed arms extending radially therefrom, with each radially extending arm terminating in a number of tines at its free end. Each tine is pointed and is curved relative to a plane of the oppositely disposed radially extending arms. Adjacent tines of a pair of tines at the end of each arm are oppositely curved relative to the plane of the radially extending arms. The discharge electrode preferably is formed of a single sheet of metal in a single pressing. A number of discharge electrodes are securable to an elongate shaft along its length to form an electrode discharge assembly for an electrostatic precipitator. The discharge electrodes can be secured to the shaft by tack welding.

14 Claims, 3 Drawing Sheets

DISCHARGE ELECTRODE

FIELD OF THE INVENTION

This invention relates to a discharge electrode and, more particularly, to a discharge electrode for use in an electrostatic precipitator. The invention extends to a discharge electrode assembly having one or more discharge electrodes, to a discharge electrode curtain made up of one or more discharge electrode assemblies, and to an electrostatic precipitator having one or more such discharge electrode curtains.

BACKGROUND TO THE INVENTION

Electrostatic precipitators are widely used to remove suspended particulate matter from gaseous emissions.

In general, an electrostatic precipitator includes one or more high voltage discharge electrodes that have portions of their surfaces designed to facilitate corona discharge therefrom. The corona discharge produces an ionising electric field through which the suspended particles in the gaseous emissions am caused to flow, thereby becoming electrically charged, or ionised.

These discharge electrodes have corresponding collector electrodes, which are grounded, and are designed to eliminate the formation of corona discharge at the surfaces. These collector electrodes attract the ionised particles in the gaseous emissions and collect these particles on the surface thereof.

In most electrostatic precipitators, the discharge electrodes are arranged vertically and are secured to masts to form elongate discharge electrode assemblies. Each discharge assembly is attached, at its operatively upper end to a hanger, which is electrically connected to a high-voltage electrical supply, to form a discharge electrode "curtain" that is suspended in the gaseous emission.

Increasingly strict emission standards have led to a continuous-demand for higher collection rates in electrostatic precipitators and this has, in turn, led to a general need for improvement in the performance of electrostatic precipitators. One of the ways of improving this performance is by increasing the charge imparted to is particulate matter by the ionisation process described above. It is known that the design and shape of a discharge electrode affects the level of corona discharge necessary for the ionisation process.

OBJECT OF THE INVENTION

It is an object of this invention to provide a discharge electrode which exhibits improved levels of corona discharge than prior art equivalents.

SUMMARY OF THE INVENTION

In accordance with this invention there is provided a discharge electrode for an electrostatic precipitator, comprising:

a collar configured to receive a shaft therethrough; and a number of elongate members extending radially from the collar, each radially extending elongate member terminating in a number of tines at the free end thereof.

Further features of the invention provide for the collar to have two radially extending elongate members, for the two radially extending elongate members to be oppositely disposed, for the free end of each radially extending elongate member to terminate in four tines, for each tine to be pointed, for each tine to be curved relative to a plane of the oppositely disposed radially extending elongate members, and for adjacent pairs of tines to be oppositely curved relative to me plane of the oppositely disposed radially extending elongate members.

Still further features of the invention provide for the collar to have a central ring formation, for the central ring formation to be arranged as two symmetric hair loops which are axially offset from each other, for the discharge electrode to be a single pressing, for the discharge electrode to be made of metal, preferably stainless steel, for each radially extending elongate member of the collar to be indented along a portion of its length, and for each radially extending elongate member of the collar to have at least one aperture extending therethrough.

The invention extends to a discharge electrode assembly, comprising:

an elongate shaft; and at least one discharge electrode, as described above, securable to the shaft.

There is also provided for the discharge electrode assembly to have a plurality of discharge electrodes securable to the elongate shaft along its length, for the plurality of discharge electrodes to be securable to the shaft along its length in an equidistant configuration, for the elongate shaft to have an engaging formation at one end thereof, for the engaging formation to be an attachment plate having an aperture extending therethrough, for each discharge electrode to be tack welded to the elongate shaft, alternatively for the discharge electrode to be securable to the elongate shaft by means of at least one screw engageable in a complementarily threaded aperture in the periphery of the collar.

The invention extends further to a discharge electrode curtain, comprising:

a supporting frame, and at least one discharge electrode assembly, as described above, securable to the supporting frame.

The invention extends still further to an electrostatic precipitator having at least one discharge electrode curtain as described herein.

BRIEF DESCRIPTION OF THE DRAWINGS

A preferred embodiment of the invention is described below, by way of example only, and with reference to the accompanying drawings in which.

DETAILED DESCRIPTION OF THE INVENTION

Figure 1:
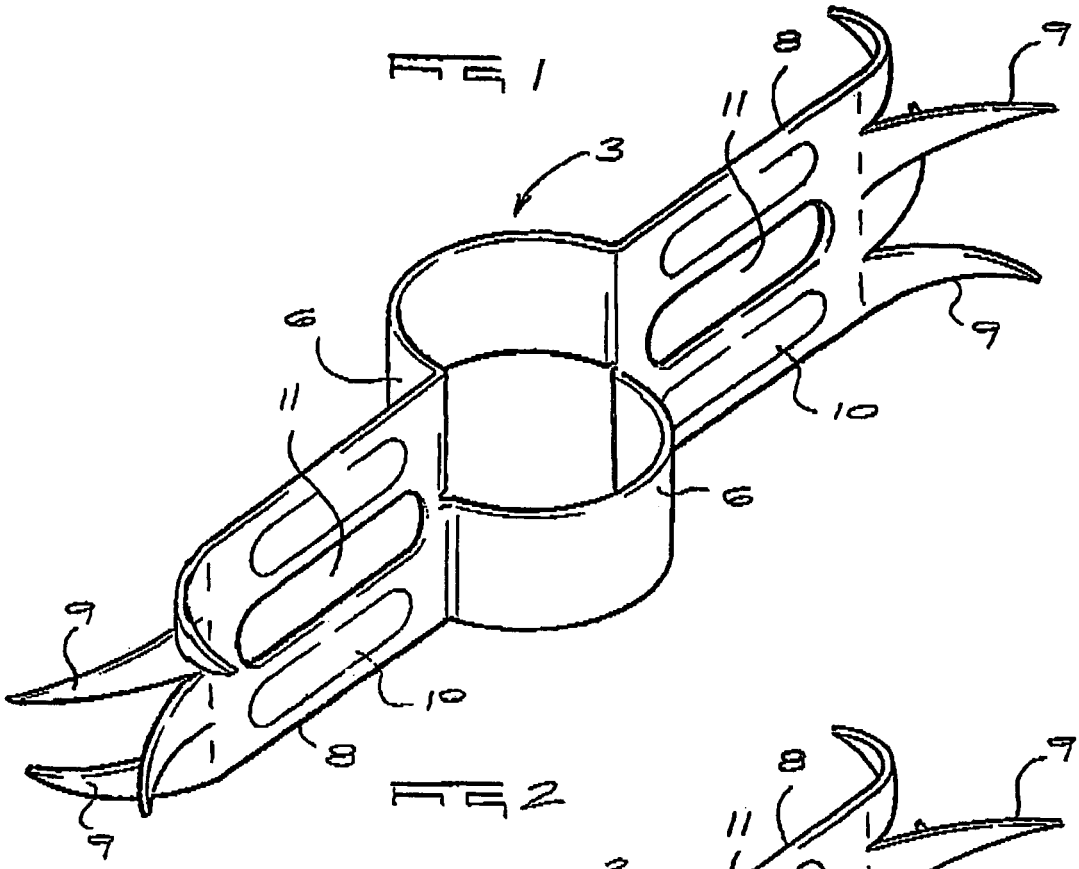
FIG. 1 is a perspective view of a first embodiment of a discharge electrode according to the invention.
Figure 2:
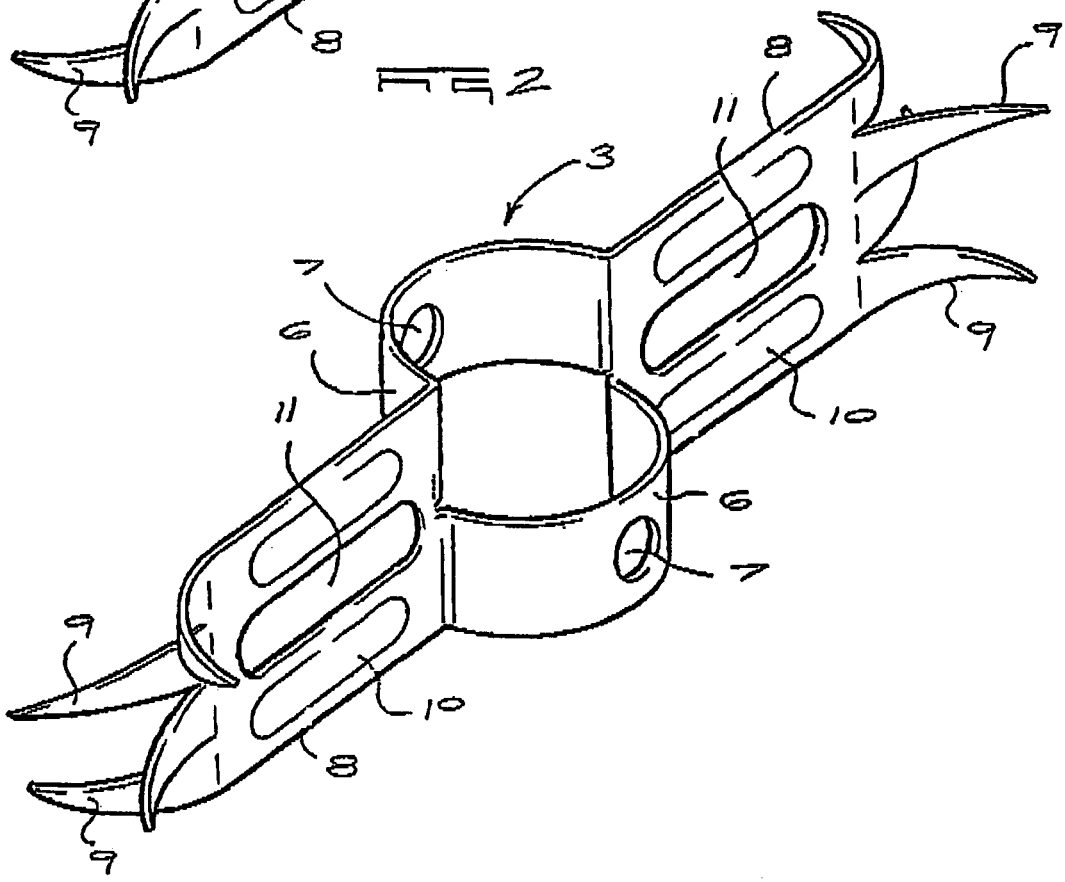
FIG. 2 is a perspective view of a second embodiment of a discharge electrode according to the invention.
Figure 3A:
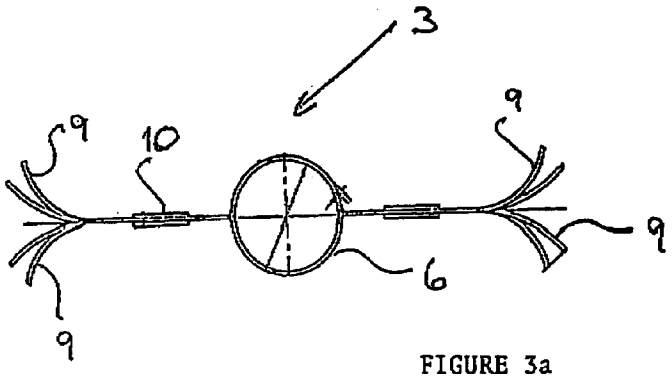
FIGS. 3*a* to 3*d* are further views of the discharge electrode of FIG. 2.
Figure 3D:
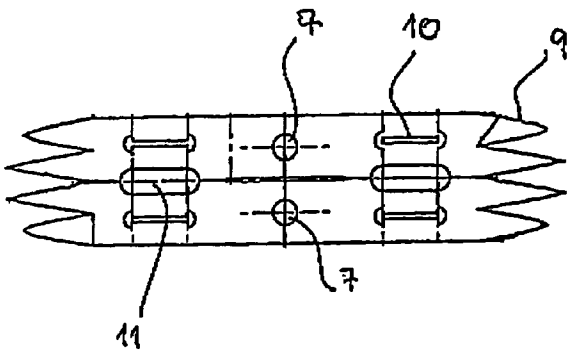
Figure 3B:
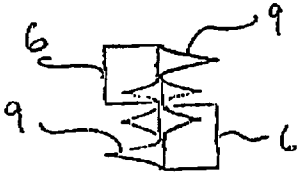
Figure 3C:
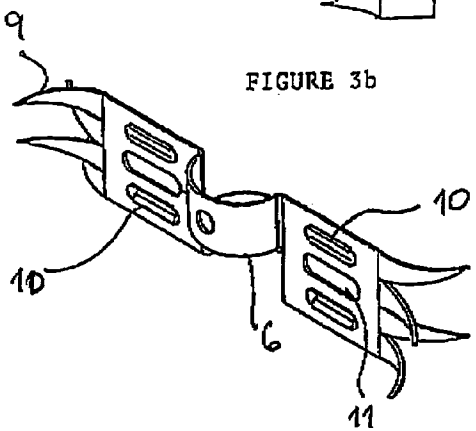

Referring to FIGS. 1 to 4, in which like features of the invention are indicated by like numerals, a discharge electrode is indicated generally by reference numeral (3).

The discharge electrode (3) is a single sheet metal pressing having a collar in the form of a central ring formation (6) arranged as two symmetric half loops that are axially offset from each other. Two oppositely disposed elongate members (8) or arms extend radially from the ring formation (6) and the free end of each elongate member terminates in four tines (9).

Each radially extending elongate member (8) is indented, at (10), along a portion of its length, in order to provide rigidity of the entire discharge electrode (3). Further, each radially extending elongate member (8) has an oblong aperture (11) extending partway along its length, the function of which will be explained in the description that follows.

Each one of the four tines (9) at the free end of the radially extending elongate member (8) is tapered to a point and each tine is curved away from a plane defined by the two oppositely disposed radially extending elongate members (8). Each adjacent pair of tines (9) at the free end of a radially extending elongate member (8) is curved in opposing directions relative to the plane defined by the two oppositely disposed radially extending elongate members (6).

Figure 4C:
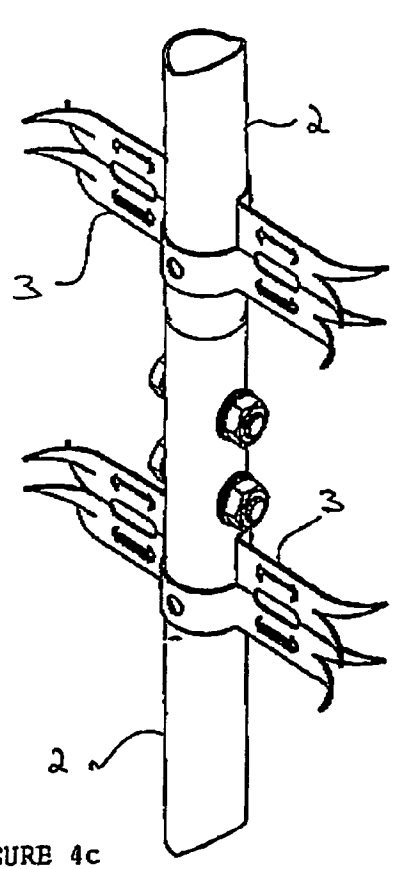
FIGS. 4*a* to 4*c* are isometric views of three variations of a discharge elide assembly according to the invention.
Figure 4A:
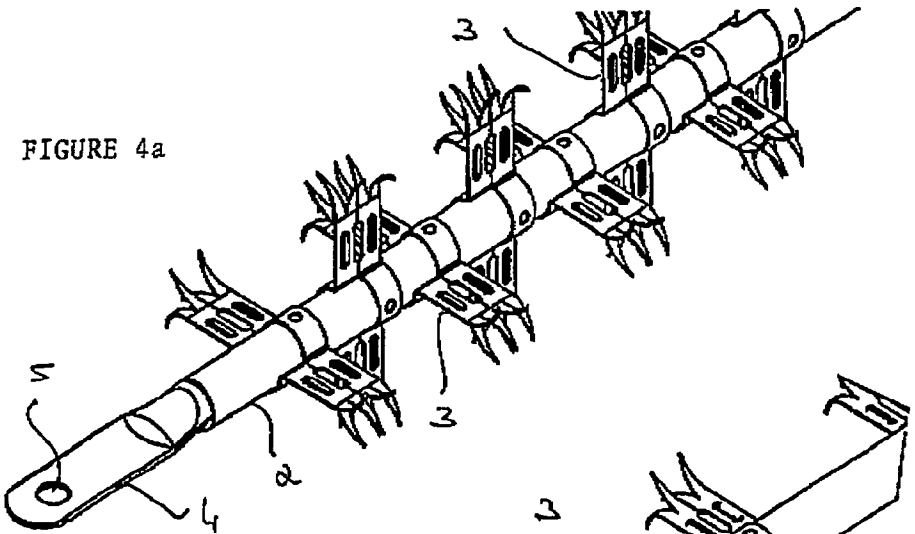
Figure 4B:
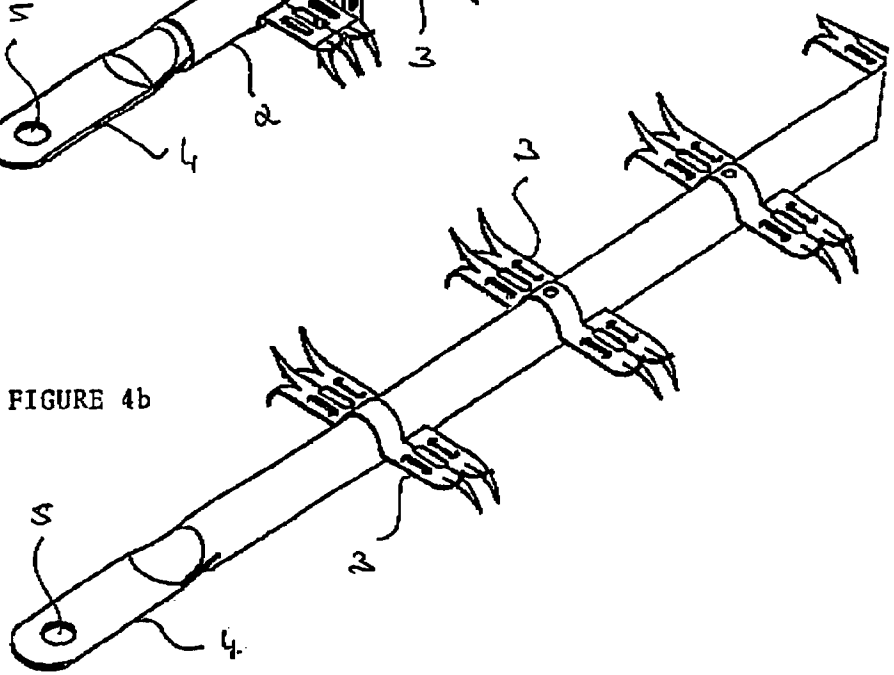

In use, a number of discharge electrodes (3) may be secured to an elongate shaft (2) to form a discharge electrode assembly, indicated generally by reference numeral (1) in FIGS. 4*a*, 4*b* and 4*c*. The numbers of discharge electrodes (3) are securable to the shaft (2) at different positions along its length by receiving the shaft through the ring formation (6) of each of the discharge electrodes and tack welding each discharge electrode to the shaft (2) at each symmetric half-loop of the central ring formation (6). The discharge electrodes (3) are secured to the shaft (2) in an equidistant configuration along its length. Furthermore, the discharge electrodes (3) can be arranged such that the oppositely disposed radially extending elongate members of adjacent discharge electrodes (3) are normal to each other, as indicated in FIG. 4*a*, or such that the radially extending elongate members of all of the discharge electrodes (3) are coplanar, as shown in FIGS. 4*b* and 4*c*.

The elongate shaft (2) has an engaging formation (4) in the form of an attachment plate with an aperture (5) therethrough, which is securable, to an operatively upper end of the shaft as indicated in FIGS. 4*a* and 4*b*. The attachment plate is formed by flattening a tube that projects outwardly from an end of the shaft (2). The flattened outwardly projecting tube may be tube may be a double tube in order to provide additional rigidity. The discharge electrode assembly (1) is securable by means of the attachment plate (4) to a supporting frame (not shown) that can be located in a flow path of a gaseous emission form which particulate matter is to be removed.

A plurality of discharge electrode assemblies (1) may be suspended from a supporting frame (not shown) by means of their respective attachment plates (4), to form a discharge electrode curtain (not shown). One or more discharge electrode curtains may be arranged, together with corresponding collector electrodes, to form an electrostatic precipitator (not shown).

It will be appreciated by those skilled in the art that the manufacture of the discharge electrodes (3) as single piece metal pressings enables a discharge electrode assembly (1) to be easily and quickly constructed. The applicant has found that the use of discharge electrodes (3) having tines (9) as described above produces higher corona discharge levels than those produced by prior art equivalent discharge electrodes. The corona effect occurs at the sharp pointed end of each one of the tines (9). The oblong apertures (11) on each radially extending elongate member are designed to minimise flow resistance in the flow path of the gaseous emission.

Numerous modifications are possible to this embodiment without departing from the scope of the invention, in particular, the curvature of each one of the tines (9) can be adjusted according to a type of collecting electrode that is used in conjunction with the discharge electrode (1). Further, a threaded aperture (7) may be centrally located on each half loop of the ring formation (6), enabling. In use, a number of discharge electrodes (3) to be secured to the shaft (2) by means of a threaded bolt through each one of the threaded apertures (7) on each half loop of the ring formation (6). Still further, the configuration of the discharge electrode (3) on the shaft (2) can be optimized on tube-type electrostatic precipitators to provide a uniform corona over an entire circumference of the tube surface. Still further, the elongate shaft (2) may be composed of multiple interlocking sections as illustrated in FIG. 4*c*.

The invention therefore provides a discharge electrode which is more efficient and a discharge electrode assembly which is easier to assemble and is more cost-effective, than prior art equivalents, and which can be easily incorporated in discharge electrode curtains for use in the electrostatic precipitators.

The invention claimed is:

1. A discharge electrode assembly for an electrostatic precipitator, comprising:

a shaft; and a plurality of discharge electrodes secured to the shaft along its length, wherein each of the discharge electrodes has a ring formation through which the shaft is received and two oppositely disposed elongate members extending radially from the ring formation, each radially extending elongate member terminating in a plurality of pointed tines at a free end thereof.

2. A discharge electrode assembly as claimed in claim 1, wherein each tine of the plurality of tines is curved relative to a plane of the oppositely disposed radially extending elongate members.

3. A discharge electrode assembly as claimed in claim 1, wherein adjacent tines of an extending elongate member are oppositely curved relative to the plane of the oppositely disposed radially extending elongate members.

4. A discharge electrode assembly as claimed in claim 1, wherein the ring formation comprises two symmetric half loops which are axially offset from each other.

5. A discharge electrode assembly as claimed in claim 4, wherein each discharge electrode is formed from a single sheet of material.

6. A discharge electrode assembly as claimed in claim 1, wherein each radially extending elongate member is indented along a portion of its length.

7. A discharge electrode assembly as claimed in claim 1, wherein each radially extending elongate member has at least one aperture extending therethrough.

8. A discharge electrode assembly as claimed in claim 1, wherein the plurality of discharge electrodes are substantially evenly spaced along the length of the shaft and secured thereto.

9. A discharge electrode assembly as claimed in claim 1, wherein each discharge electrode is tack welded to the shaft.

10. A discharge electrode assembly as claimed in claim 1, wherein each discharge electrode is secured to the shaft by means of at least one screw engageable in a complementarily threaded aperture in a periphery of the ring formation.

11. A discharge electrode assembly as claimed in claim 1, wherein the shaft has an engaging formation at an end thereof.

12. A discharge electrode assembly as claimed in claim 11, wherein the engaging formation is an attachment plate having an aperture extending therethrough.

13. A discharge electrode assembly as claimed in claim 3, wherein the adjacent tines of an extending elongate member have different radii of curvature.

14. A discharge electrode as claimed in claim 1 wherein each said extending elongate member has four tines at its free end.

* * * * *